US008400393B2

(12) United States Patent
Huang

(10) Patent No.: US 8,400,393 B2
(45) Date of Patent: Mar. 19, 2013

(54) METHOD OF CONTROLLING BACKLIGHT MODULE, BACKLIGHT CONTROLLER AND DISPLAY DEVICE USING THE SAME

(75) Inventor: Ling-Hsiu Huang, Tainan County (TW)

(73) Assignee: Himax Technologies Limited, Tainan (TW)

( * ) Notice: Subject to any disclaimer, the term of this patent is extended or adjusted under 35 U.S.C. 154(b) by 1181 days.

(21) Appl. No.: 12/056,929

(22) Filed: Mar. 27, 2008

(65) Prior Publication Data

US 2009/0244438 A1 Oct. 1, 2009

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

2007/0239756 A1 10/2007 Li et al.
2007/0268242 A1* 11/2007 Baba et al. ..... 345/102
2007/0279715 A1* 12/2007 Morikawa ..... 358/518
2008/0297464 A1* 12/2008 Ito ..... 345/102
2009/0002400 A1* 1/2009 Ha et al. ..... 345/690

OTHER PUBLICATIONS

"Office Action of Taiwan Counterpart Application", issued on Sep. 21, 2012, p1-p10, in which the listed reference was cited.

* cited by examiner

*Primary Examiner* — Alexander S Beck
*Assistant Examiner* — Nguyen H Truong
(74) *Attorney, Agent, or Firm* — J.C. Patents

(57) ABSTRACT

A method of controlling backlight module, a backlight controller and a display device using the same are provided herein. First, an image having a plurality of regions is received, wherein the image is displayed by a plurality of color backlights which are provided from the backlight module. Next, a first average of a characteristic in a specific region of the image is calculated, wherein the specific region is one of the regions. According to the first average of the characteristic and a weight function, a characteristic weight is calculated. Next, one of the color backlights provided to the specific region is adjusted according to the characteristic weight. Therefore, adjusting the color backlights according to the image content can enhance the displaying quality of the image and adaptively reduce the artifacts perceived by human eyes in different images.

21 Claims, 4 Drawing Sheets

METHOD OF CONTROLLING BACKLIGHT MODULE, BACKLIGHT CONTROLLER AND DISPLAY DEVICE USING THE SAME

BACKGROUND OF THE INVENTION

1. Field of the Invention

The present invention relates to a method of controlling a backlight module, a backlight controller and a display device using the same, and more particularly, to adjust the backlights according to the image content.

2. Description of Related Art

With great advance in the techniques of electro-optical and semiconductor devices, flat panel displays, such as liquid crystal displays (LCD), have enjoyed burgeoning development and flourished in recent year. Due to the numerous advantages of the LCD, such as low power consumption, free of radiation, and high space utilization, the LCD has become the main stream in the market. An LCD includes a liquid display panel and a backlight module. The liquid display panel has no capacity of emitting light by itself so that the backlight module is arranged below the liquid display panel to provide the surface light source for the liquid display panel so as to perform the display function.

Generally, a cold cathode fluorescent lamp (CCFL) is disposed on the backlight module and is used for providing a white light as the backlight. Nevertheless, the luminance of the white light depends on the dimension of the CCFL and it is difficult to design a light, thin and small LCD by using the CCFL. Owing to the advantages of the light emitting diodes (LEDs), such as smaller size, lower cost, higher luminance, and higher operational life than the CCFL, the LED gradually replaces the CCFL to provide the backlight.

As for the LED backlight, there are two methods to produce the white light. The first method is to use a white light LED manufactured from a blue LED spread with a fluorescent powder. The white light is produced when the fluorescent powder is excited by the blue light, and the white lights with different color temperatures can be produced by using different fluorescent powders. However, the light-emitting efficiency the white light LED is lower when initially operated and then would cause the luminance of display screen lower. Moreover, the white light often approaches to a blue or a green wave band and does not match the color filters.

The second method is to utilize the red, green and blue LEDs to mix for various color backlights including the white light. Since the wavelengths of the red, green and blue LEDs are close to the transmission wave peaks of the color filters, the color rendering of the mixed white light can be exceed more than 100% of the standards stipulated by National Television Standards Committee (NTSC). Furthermore, the color temperature of the mixed white light can be freely adjusted by regulating the luminance of light emitted from the red, green or blue LEDs.

In general, the backlights provided by the red, green and blue LEDs can be adjusted brightness and dimness synchronously or separately. There are several advantages of separately adjusting brightness and dimness of the backlights from the red, green and blue LEDs, such as color gamut enlargement and power reduction, etc. Nevertheless, in some images, the artifacts perceived by human eyes would appear through separately adjusting brightness and dimness of the backlights provided by the red, green and blue LEDs. For example, human eyes may perceive the color shifts in the images with lower color saturation or perceive the motion compensation error in the darker images. Therefore, how to control the backlights according to the images becomes an important issue to be researched and discussed.

SUMMARY OF THE INVENTION

Accordingly, the present invention provides a method of controlling a backlight module, a backlight controller and a display device using the same. The controlling method adjusts the backlights according to the characteristic of an image, such as luminance or chrominance of the image or both of them. The lower the characteristic of the image is, the more the backlights need to be adjusted brightness and dimness synchronously. Therefore, the artifacts perceived by human eyes in different images can be properly reduced. Furthermore, the backlight controller and the display device are carried out according to the controlling method and have the said advantages.

A method of controlling a backlight module is provided in the present invention. First, an image having a plurality of regions is received, wherein the image is displayed by a plurality of color backlights provided by the backlight module. Next, a first average of a characteristic in a specific region of the image is calculated, wherein the specific region is one of the regions. According to the first average of the characteristic and a weight function, a characteristic weight is calculated. Next, one of the color backlights provided to the specific region is adjusted according to the characteristic weight.

A backlight controller including an analysis module and a decision module is provided in the present invention for controlling a backlight module to provide a plurality of color backlights. The analysis module receives an image having a plurality of regions and calculates a first average of a characteristic in a specific region of the image and calculates a characteristic weight according to the first average of the characteristic and a weight function, wherein the specific region is one of the regions. The decision module is coupled to the analysis module and adjusts one of the color backlights provided to the specific region according to the characteristic weight.

A display device including a display panel, a backlight module and a backlight controller is provided in the present invention. The display panel is used for displaying an image having a plurality of regions. The backlight module is coupled to the display panel and provides a plurality of color backlights to the display panel so as to display the image. The backlight controller is coupled to the backlight module and analyzes a characteristic in a specific region of the image for adjusting one of the color backlights provided to the specific region and controls the backlight module to provide the adjusted color backlight, wherein the specific region is one of the regions.

The present invention provides a method of controlling a backlight module, a backlight controller and a display device using the same which adjust the backlights according to the characteristic of the image. If the characteristic of the image is lower, the backlights need to be adjusted brightness and dimness synchronously to avoid the artifacts perceived by human eyes. On the contrary, if the characteristic of the image is higher, the backlights need to be adjusted brightness and dimness separately for enlarging the color gamut and reducing the power consumption. Therefore, according to the aforementioned weight function and the characteristic of the image, the characteristic weight is obtained for controlling the adjusted amount of the backlights and the artifacts perceived by human eyes in different images can be properly reduced.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
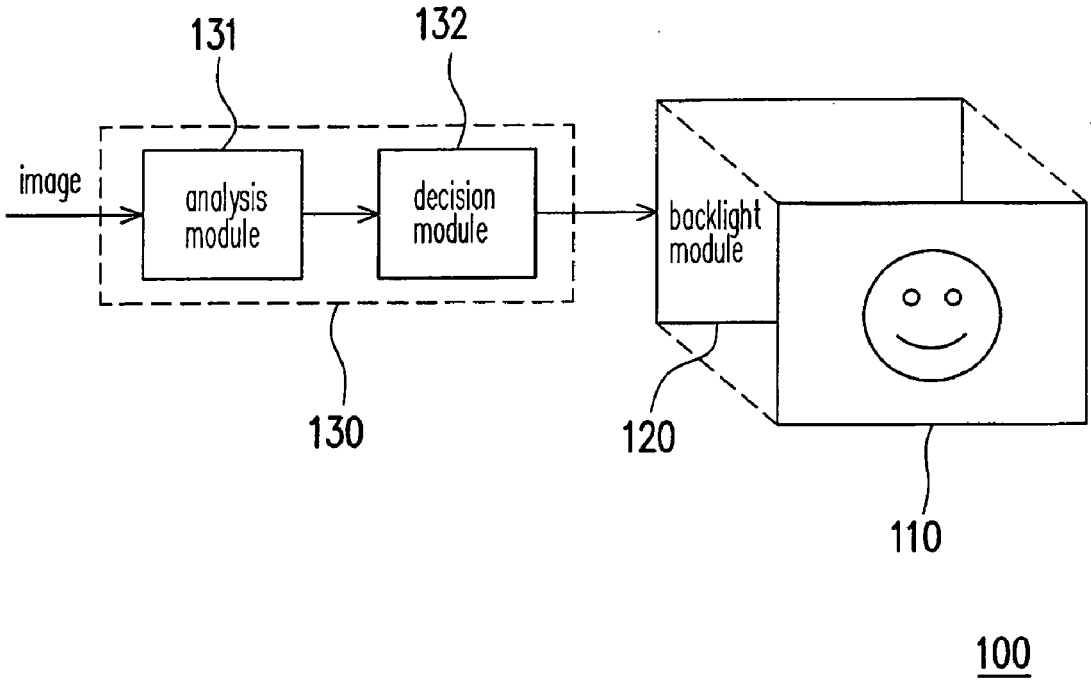
FIG. 1 is a block diagram of a display device according to one embodiment of the present invention.

FIG. 1 is a block diagram of a display device according to one embodiment of the present invention. Referring to FIG. 1, the display device 100 includes a display panel 110, a backlight module 120 and a backlight controller 130. The display panel 110 is used for displaying an image, wherein the image has a plurality of regions. The backlight module 120 is coupled to the display panel 110 and provides a plurality of color backlights, such as red, green, and blue, to the display panel 110 so as to display the image. The backlight controller 130 is coupled to the backlight module 120 and includes an analysis module 131 and a decision module 132. The backlight controller 130 analyzes a characteristic in a specific region of the image for adjusting one of the color backlights provided to the specific region and controls the backlight module 120 to provide the adjusted color backlight, wherein the specific region is one of the regions.

Figure 2:
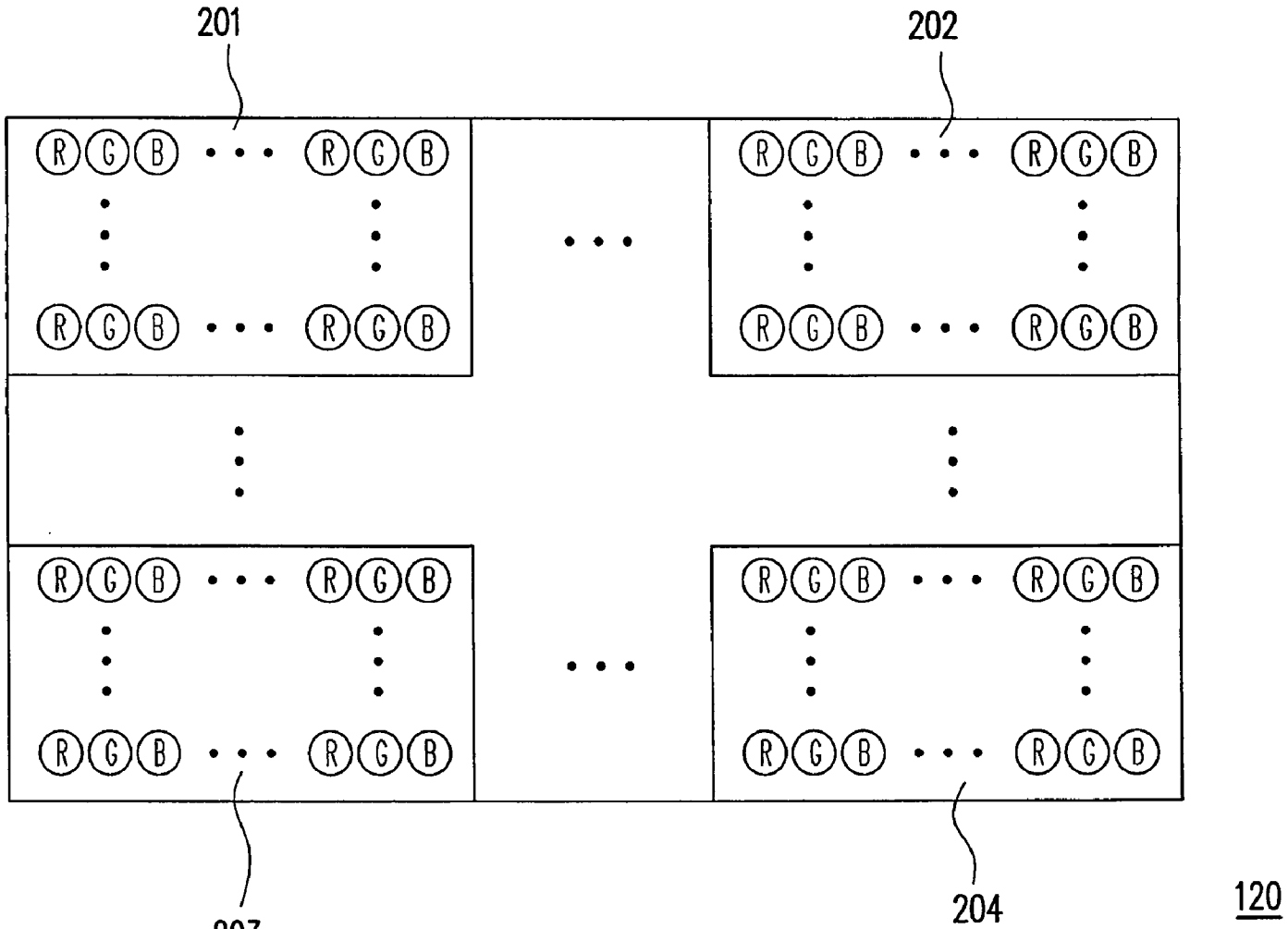
FIG. 2 is a diagram of the backlight module according to one embodiment of the present invention.

FIG. 2 is a diagram of the backlight module 120 according to one embodiment of the present invention. In the embodiment, referring to FIG. 2, a red (R), a green (G), and a blue (B) light emitting diodes (LEDs) are supposed to be disposed on one of the display pixels in the backlight module 120 so as to provide the said color backlights. Since the image has a plurality of regions, the backlight module 120 can also be separated into the said regions, such as regions 201-204 (only four regions are shown for description herein). To enhance the displaying quality of the image, it is important to control the luminance of the color backlights, that is, adjusting brightness and dimness of the color backlights. For the convenience of description, the luminance of the red, green, and blue backlights provided to the specific region are respectively named Lpc(R), Lpc(G), and Lpc (B).

The backlight controller 130 includes the analysis module 131 and the decision module 132. Generally, the luminance and chrominance are two significant characteristics of the image. If the luminance or the chrominance is low, separately adjusting brightness and dimness of the color backlights would cause the artifacts, such as color shifts. In the embodiment of the present invention, the luminance is supposed to be the said characteristic. Referring to FIG. 2, taking the region 201 as the specific region as an example the analysis module 131 receives the image and calculates a first average AVG of the characteristic in the specific region of the image, and calculates a characteristic weight W according to the first average AVG of the characteristic and a weight function. The decision module 132 is coupled to the analysis module 131 and adjusts one of the color backlights provided to the specific region according to the characteristic weight W.

Figure 3B:
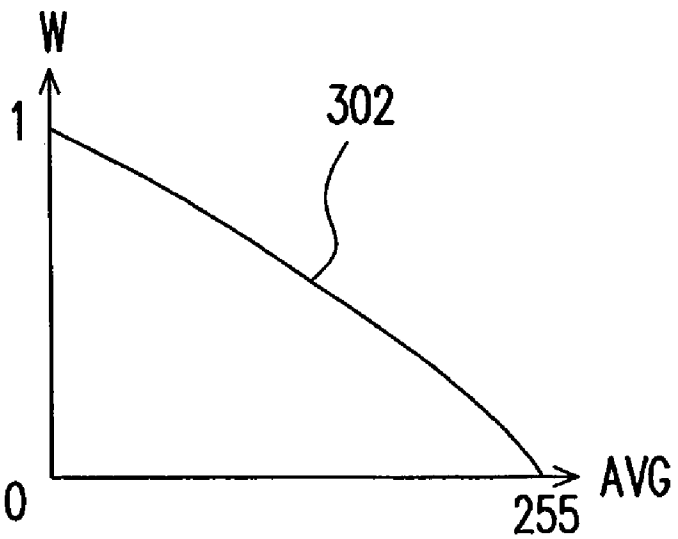
FIG. 3B is a curve diagram of a weight function according to one embodiment of the present invention.
Figure 3A:
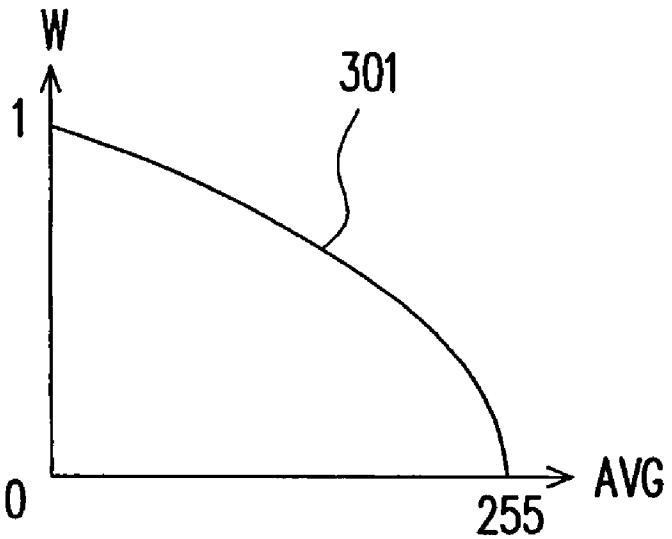
FIG. 3A is a curve diagram of a weight function according to one embodiment of the present invention.

FIG. 3A is a curve diagram of the weight function according to one embodiment of the present invention. In the embodiment, the weight function is obtained by experiments and is a relation between the first average AVG and the characteristic weight W. Referring to FIG. 3A, the gray-level values between 0~255 are assumed to represent the first average AVG of the characteristic (such as luminance) in the specific region of the image. The curve 301 of the weight function is nonlinear, as shown in FIG. 3A, the characteristic weight W decreases when the first average AVG increases. Therefore, the analysis module 131 utilizes the calculated first average AVG of the characteristic (such as luminance) to obtain the characteristic weight W according to the weight function (as shown in FIG. 3A).

Next, the decision module 132 adjusts one of the color backlights provided to the specific region according to the characteristic weight W, wherein the adjusted color backlight is a weight sum Lws of the one of the color backlights Lpc provided to the specific region and a specific value L, and the weight sum Lws is related to the characteristic weight W. For example, the adjusted red backlight Lws(R) equals $Lps(R)\times(1-W)+L\times W$, wherein the specific value L is the maximum of the color backlights provided to the specific region, in mathematics form, $L=\max(Lps(R), Lps(G), Lps(B))$. By analogy, the adjusted green backlight Lws(G) equals $Lps(G)\times(1-W)+L\times W$, and the adjusted blue backlight Lws(B) equals $Lps(B)\times(1-W)+L\times W$. In another embodiment of the present invention, the specific value L is a second average of the color backlights provided to the specific region, in mathematics form, $L=(Lps(R)+Lps(G)+Lps(B))/3$.

Besides, FIG. 3B is a curve diagram of the weight function according to another embodiment of the present invention. Referring to FIG. 3B, the gray-level values between 0-255 are assumed to represent the first average AVG of the characteristic (such as chrominance) in the specific region of the image. The curve 302 of the weight function is nonlinear (as shown in FIG. 3B) and the characteristic weight W decreases when the first average AVG increases. Referring to and comparing FIG. 3A and FIG. 3B, because human eyes have more sensitivity to the luminance of the image than to the chrominance of the image, the curve 301 decreases with smaller deviation than the curve 301 when the first average AVG increases. The analysis module 131 utilizes the calculated first average AVG of the characteristic (such as chrominance) to obtain the characteristic weight W according to the weight function (as shown in FIG. 3B). Then the decision module 132 adjusts one of the color backlights as the above-mentioned description of the embodiment so that further details are omitted herein.

In the foregoing embodiments of the present invention, the adjusted color backlight is determined by one of the luminance and the chrominance in the specific region of the image. In the preferred embodiment of the present invention, both of the luminance and the chrominance in the specific region of the image are referred to adjust one of the color backlights. For example, the analysis module 131 calculates a luminance average AVGy in the specific region of the image and obtains a luminance weight Wy according to the luminance average AVGy and the weight function as shown in FIG. 3A. Besides, the analysis module 131 also calculates a chrominance average AVGc in the specific region of the image and obtains a chrominance weight Wc according to the chrominance average AVGc and the weight function as shown in FIG. 3B.

Next, the decision module 132 adjusts one of the color backlights provided to the specific region according to both of the luminance weight Wy and the chrominance weight Wc. According to the embodiments of the present invention, by referring to the luminance weight Wy, the first adjusted color backlight Lws equals Lps×(1−Wy)+L×Wy, wherein L is the maximum of the color backlights, that is, the maximum of Lps(R), Lps(G) and Lps(B) provided to the specific region, or L is the second average of the color backlights provided to the specific region. To carry on referring to the chrominance weight Wc, the second adjusted color backlight Lws' equals Lws×(1−Wc)+L'×Wc, wherein L' is the maximum of the first adjusted color backlights, that is, the maximum of Lws(R), Lws(G) and Lws(B) provided to the specific region, or L' is an average of the first adjusted color backlights provided to the specific region. It is noted that, the order of referring to the luminance weight Wy and the chrominance weight Wc is not intended to limit the spirit of the invention.

Figure 4:
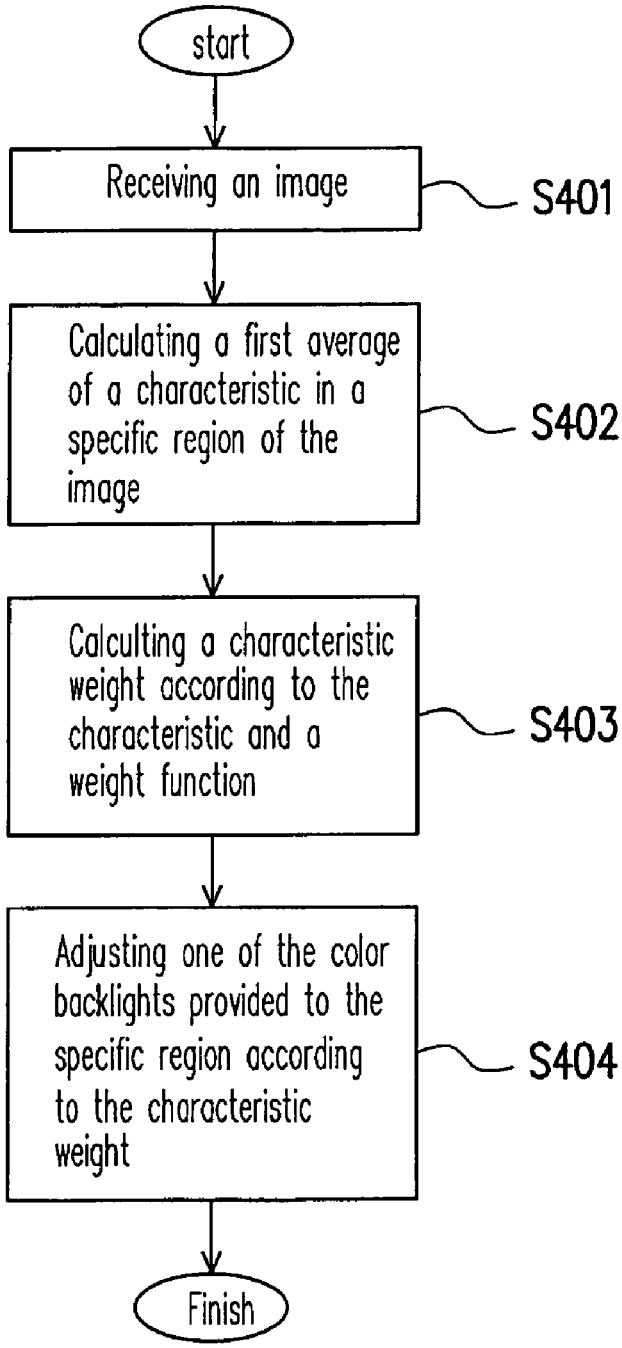
FIG. 4 is a flow chart of a method of controlling a backlight module according to one embodiment of the present invention.

According to the embodiments described above, the steps of the following method could be generalized. FIG. 4 is a flow chart of a method of controlling the backlight module according to one embodiment of the present invention. First, in step S401, an image is received, wherein the image has a plurality of regions. Next, a first average of a characteristic in a specific region of the image is calculated in step S402 and a characteristic weight is calculated according to the first average of the characteristic and a weight function in step S403. Next, in step S404, one of the color backlights provided to the specific region is adjusted according to the characteristic weight.

In summary, the embodiments of the present invention adjust the color backlights according to the significant characteristics of the image, such as luminance and chrominance. The embodiments of the present invention utilize the weight function and the first average of the characteristic in each region of the image to obtain the characteristic weight which controls the adjusted amount of the color backlights provided to each region. Through adjusting the color backlights by regions, not only can the artifacts caused by improperly adjusting brightness and dimness of the color backlights be reduced, but the displaying quality of the image can also be finely and delicately enhanced.

Although the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A method of controlling a backlight module, comprising:

receiving an image, wherein the image has a plurality of regions and the image is displayed by a plurality of color backlights provided by a backlight module;

calculating a first average of a characteristic in a specific region of the image, wherein the specific region is one of the regions;

calculating a characteristic weight according to the first average of the characteristic and a weight function; and adjusting one of the color backlights provided to the specific region according to the characteristic weight by calculating a weight sum of the one of the color backlights provided to the specific region and a specific value, wherein the weight sum equals to Lpcx(1−W)+L×W, Lpc is a characteristic of each of the color backlights of Lpc(R) for first primary color, Lpc(G) for second primary color and Lpc(B) for third primary color, provided to the specific region, L is the specific value, and W is the characteristic weight, wherein the specific value L is a maximum of Lpc(R), Lpc(G) and Lpc(B) provided to the specific region, or is an average of Lpc (R), Lpc(G) and Lpc(B) provided to the specific region.

2. The method of controlling the backlight module as claimed in claim 1, wherein the specific value is a maximum of the color backlights provided to the specific region.

3. The method of controlling the backlight module as claimed in claim 1, wherein the specific value is a second average of the color backlights provided to the specific region.

4. The method of controlling the backlight module as claimed in claim 1, wherein the weight function is a nonlinear curve in which the characteristic weight decreases when the first average of the characteristic increases.

5. The method of controlling the backlight module as claimed in claim 1, wherein the color backlights are red, green and blue.

6. The method of controlling the backlight module as claimed in claim 1, wherein the characteristic is luminance.

7. The method of controlling the backlight module as claimed in claim 1, wherein the characteristic is chrominance.

8. A backlight controller for controlling a backlight module to provide a plurality of color backlights, comprising:

an analysis module, receiving an image having a plurality of regions, for calculating a first average of a characteristic in a specific region of the image and calculating a characteristic weight according to the first average of the characteristic and a weight function, wherein the specific region is one of the regions; and a decision module, coupled to the analysis module, for adjusting one of the color backlights provided to the specific region according to the characteristic weight by a weight sum equals to Lpcx(1−W)+L×W, wherein Lpc is a characteristic of each of the color backlights of Lpc(R) for first primary color, Lpc(G) for second primary color and Lpc(B) for third primary color, provided to the specific region, L is a specific value, and W is the characteristic weight, wherein the specific value L is a maximum of Lpc(R), Lpc(G) and Lpc(B) provided to the specific region, or is an average of Lpc(R), Lpc(G) and Lpc(B) provided to the specific region.

9. The backlight controller as claimed in claim 8, wherein the specific value is a maximum of the color backlights provided to the specific region.

10. The backlight controller as claimed in claim 8, wherein the specific value is a second average of the color backlights provided to the specific region.

11. The backlight controller as claimed in claim 8, wherein the weight function is a nonlinear curve in which the characteristic weight decreases when the first average of the characteristic increases.

12. The backlight controller as claimed in claim 8, wherein the color backlights are red, green and blue.

13. The backlight controller as claimed in claim 8, wherein the characteristic is luminance.

14. The backlight controller as claimed in claim 8, wherein the characteristic is chrominance.

15. A display device, comprising:

a display panel, for displaying an image, wherein the image has a plurality of regions;

a backlight module, coupled to the display panel, for providing a plurality of color backlights to the display panel to display the image; and a backlight controller, coupled to the backlight module for analyzing a characteristic in a specific region of the image to adjust one of the color backlights provided to the specific region and controlling the backlight module to provide the adjusted color backlight, wherein the specific region is one of the regions.

wherein the backlight controller comprises:

an analysis module, receiving the image, for calculating a first average of the characteristics in the specific region of the image, and calculating a characteristic weight according to the first average of the characteristic and a weight function; and a decision module, couple to the analysis module, for adjusting the one of the color backlights provided to the specific region according to the characteristic weight by a weight sum equals to Lpcx (1−W)+L×W, wherein Lpc is a characteristic of each of the color backlights of Lpc(R) for first primary color, Lpc(G) for second primary color and Lpc(B) for third primary color, provided to the specific region, L is a specific value, and W is the characteristic weight, wherein the specific value L is a maximum of Lpc(R), Lpc(G) and Lpc(B) provided to the specific region, or is an average of Lpc(R), Lpc(G) and Lpc(B) provided to the specific region.

16. The display device as claimed in claim 15, wherein the specific value is a maximum of the color backlights provided to the specific region.

17. The display device as claimed in claim 15, wherein the specific value is a second average of the color backlights provided to the specific region.

18. The display device as claimed in claim 15, wherein the weight function is a nonlinear curve in which the characteristic weight decreases when the first average of the characteristic increases.

19. The display device as claimed in claim 15, wherein the color backlights are red, green and blue.

20. The display device as claimed in claim 15, wherein the characteristic is luminance.

21. The display device as claimed in claim 15, wherein the characteristic is chrominance.

* * * * *